US007350770B1

(12) United States Patent
Boyer

(10) Patent No.: US 7,350,770 B1
(45) Date of Patent: Apr. 1, 2008

(54) AIR CONDITIONER COMPRESSOR HOIST

(76) Inventor: John N. Boyer, 203 Eveningside Dr., Chattanooga, TN (US) 37404

( * ) Notice: Subject to any disclaimer, the term of this patent is extended or adjusted under 35 U.S.C. 154(b) by 0 days.

(21) Appl. No.: 11/652,443

(22) Filed: Jan. 11, 2007

Related U.S. Application Data

(60) Provisional application No. 60/837,777, filed on Aug. 15, 2006.

(51) Int. Cl.
*B66D 1/00* (2006.01)

(52) U.S. Cl. ..... 254/332; 414/543; 212/295

(58) Field of Classification Search ..... 254/329, 254/332, 334, 335, 336, 338, 356, 342; 414/543; 212/295
See application file for complete search history.

(56) References Cited

U.S. PATENT DOCUMENTS 1,456,356 A * 5/1923 Bentley ..... 211/29
1,978,999 A * 10/1934 Jones ..... 254/334
3,671,015 A * 6/1972 Sullivan ..... 254/332
3,948,482 A * 4/1976 Brophy ..... 254/4 R
4,771,988 A * 9/1988 Scroggins, Sr. ..... 254/336
5,431,526 A * 7/1995 Peterson et al. ..... 414/543
5,975,499 A * 11/1999 Ostrobrod ..... 254/332
6,138,991 A * 10/2000 Myers, Jr. ..... 254/323
6,189,866 B1 * 2/2001 Harkins et al. ..... 254/332

* cited by examiner

*Primary Examiner*—Emmanuel M Marcelo
(74) *Attorney, Agent, or Firm*—Stephen J. Stark; Miller & Martin PLLC

(57) ABSTRACT

The present invention provides a portable hoist for use by air conditioner mechanics, or others, to lift compressors in and out of HVAC units (or other heavy objects). The hoist has a lifting arm rotatable relative to a base and preferably provides a compact storage configuration.

13 Claims, 2 Drawing Sheets

AIR CONDITIONER COMPRESSOR HOIST

CLAIM OF PRIORITY

This application claims the benefit of U.S. Provisional Patent Application No. 60/837,777 filed Aug. 15, 2006.

FIELD OF THE INVENTION

The present invention relates to a hoist for use in lifting air conditioner compressors principally from residential air conditioners, and more particularly, to a portable hoist that can be relatively easily set up and support the loading created by a hoist to prevent an operator from straining his or her back during the compressor replacement procedure.

DESCRIPTION OF RELATED ART

Air conditioner compressors as used in residential heating units or others can be rather heavy structures. Although they may not be particularly large, such as short as a foot and perhaps having a diameter of about ten inches or so in some embodiments, they still may weigh a hundred to a hundred and fifty pounds in some embodiments. Furthermore, although they typically have a D-ring on one side of them towards the top, they are not normally equipped with a handle, and even if they were, it would still require bending over and pulling either with the legs or straining one's back to lift a compressor out of a unit for replacement with another compressor.

While the applicant is aware that at least one company provides a handle which connects to the D-ring of a compressor, this creates another set of problems in that it elevates the point of contact by placing the handle above the compressor. The compressor has to be lifted even higher for clearance to remove it by a person.

There is a need to provide an improved method and device for removing compressors from air conditioning units from stationary air conditioner applications such as from buildings (i.e., houses, industrial applications, etc.).

There is another need for an improved method or device for lifting air conditioner compressors which does not strain the back of a worker from bending and picking up heavy objects.

SUMMARY OF THE INVENTION

It is an object of the present invention to provide an air conditioning compressor hoist which is preferably portable and easy to set up while providing satisfactory lifting capabilities to lift a compressor up and out of an air conditioning unit.

It is another object of the present invention to provide an air conditioner hoist which allows a compressor to be lifted and rotated out of the way and to allow for the lifting and installation of a replacement compressor.

The presently preferred embodiment of the present invention provides an air conditioner hoist with a base which preferably can be quickly set up. The base preferably provides legs which extend out preferably from a center a sufficient distance so that a lifting arm of a hoist does not extend beyond a perimeter defined about the legs of the base.

Furthermore, the lifting arm of the hoist is preferably rotatable relative to the base and a lifting system preferably pulls a hook which can be connected to the D-ring of the compressor. The pulling system can provide a ratcheting crank. The air compressor can be quickly lifted and then turned out of the way, placed on the ground and another replacement compressor put in its place without a need for the operator to lift load under strain. The base may take a variety of forms including a folding arrangement and/or a leg arrangement which can be relatively quickly assembled and disassembled for ease in portability and maintaining a lightweight hoist.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
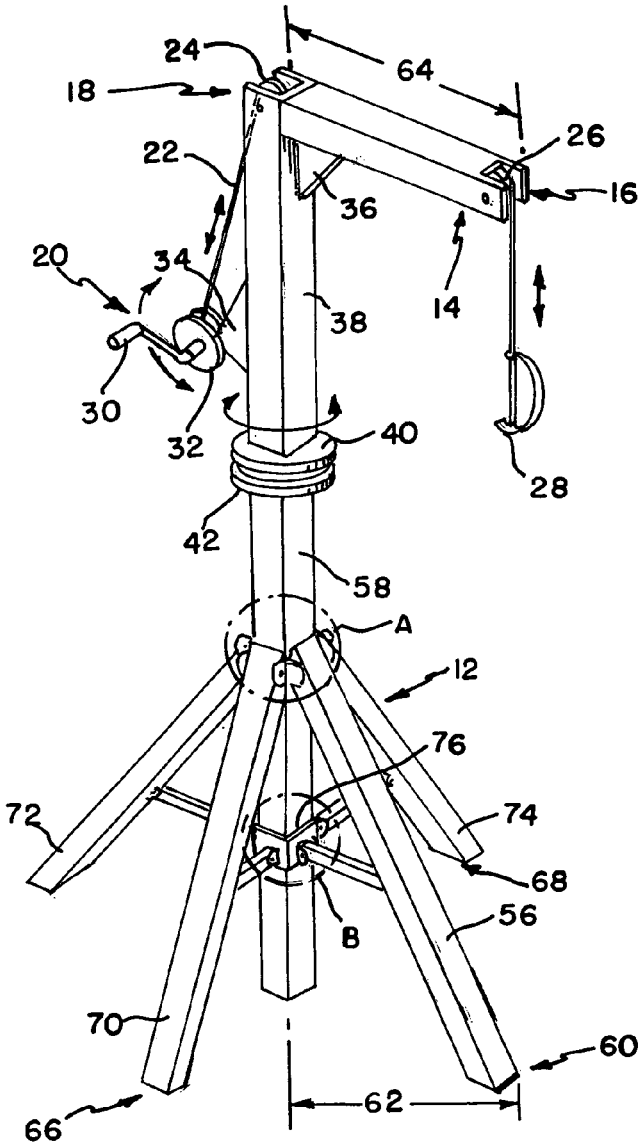
FIG. 1 is a side elevational view of the presently preferred embodiment of the present invention.

FIG. 1 shows a presently preferred embodiment of the present invention. Specifically, a hoist 10 has a base 12 and a lifting arm 14. The lifting arm 14 is preferably rotatable relative to base 12 which will be explained in detail below.

The lifting arm 14 is preferably open at first end 16 as well as at second end 18 so that lifting system 20 can pass a wire or other cord 22 therethrough. Furthermore, contact points such as pulleys 24,26 are useful to provide a relatively frictionless way of redirecting cord 22 so that it can lift up and down as illustrated in FIG. 1. Hook 28 is useful for connecting to a D-ring of a compressor or other portion on a compressor for lifting. Other connection devices could be employed in other embodiments.

In a preferred method of operation, a lifting system 20 can be operated by a turning crank 30 which turns drum 32 which may be temporarily held with a ratchet panel 34 in some embodiments to pull cord 22 to which hook 28 is connected to a D-ring of a compressor. The compressor would be lifted upward through this mechanism as would be understood by one of ordinary skill in the art.

Figure 4:
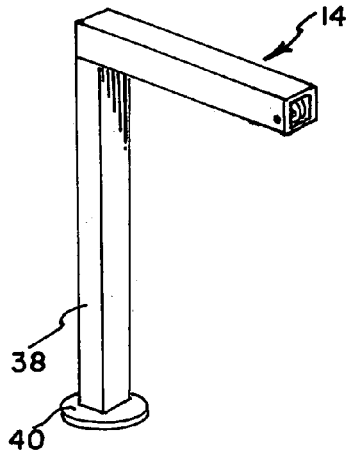
FIG. 4 is an exploded figure of a portion of the hoist shown in FIG. 1.
Figure 4:
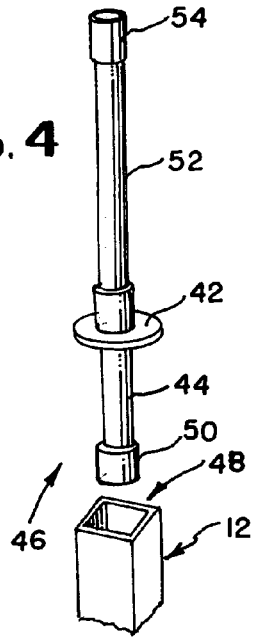

Gusset 36 is useful to assist in supporting loads supported by hook 28. In fact, in the preferred embodiment, 180 pounds has been successfully tested to be supported. Since most residential compressors weigh on the order of 150 pounds or less, the hoist end has been found to work particularly satisfactorily in field tests. The gusset 36 preferably supports lifting arm 14 relative to support 38. The support 38 and arm 14 are preferably rotatable with first thrust plate 40 resting on a second thrust plate 42 and rotatable thereabout. Of course, various bearing surfaces could be located in between the first and second thrust plates 40,42 or not, depending on the particular embodiment. Second thrust plate 42 is preferably non-rotatable connected to the base 12 as will be understood by one of ordinary skill in the art with explanation related to FIG. 4. Second thrust plate 42 could be rotatable in other embodiments.

A conduit 44 preferably has a bottom 46 that is inserted in a top 48 of the base 12 which can be tubular channel stock or other material. A coupling 50 at the bottom portion 46 of the conduit 44 can be spot welded or otherwise securely connected to the base 12 such as by drilling holes where the coupling 50 is disposed in the base 12 and then welding thereto. Of course, other connection mechanisms could be utilized as will be understood by one of ordinary skill in the art. Furthermore, it may be that the conduit 44 could be removably connected to base 12. The coupling 50 could be designed so that it cannot rotate either partially or completely internal to the base 12 such as by providing with a cross section of the portion of the base 12 such as by providing a square cross section with a diagonal that was larger than the smallest diameter of the cross section of the base 12 would prevent complete rotation.

With the conduit 44 connected to base 12, an upper conduit portion 52 extends upwardly for which the support 38 can then be placed thereover. This support 38 is preferably also constructed out of tubular stock such as having similar construction as the tubular stock utilized for base 12. The first thrust plate 40 preferably has an opening which allows the insertion of the upper portion 52 of the conduit 44 therethrough. An upper coupling 54 is useful to reduce the amount of movement of the support 38 relative to the conduit 44 when it is installed so that it does not rattle in the preferred embodiment. Of course, other constructions can be utilized in other embodiments.

The support 38 is preferably not securely connected to the conduit 44 so that the support 38 and lifting arm 14 can rotate relative to the base 12 as would be understood by one of ordinary skill in the art. The remainder of the base may be constructed in at least two ways and probably a number of others. In the embodiments envisioned currently by the applicant, they presently have a common feature.

Figure 8:
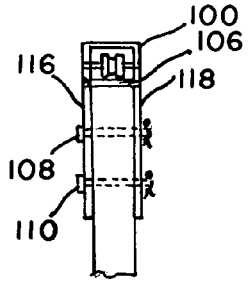
FIG. 8 is a front view of the alternatively preferred embodiment of the lifting arm as shown in FIG. 6.
Figure 9:
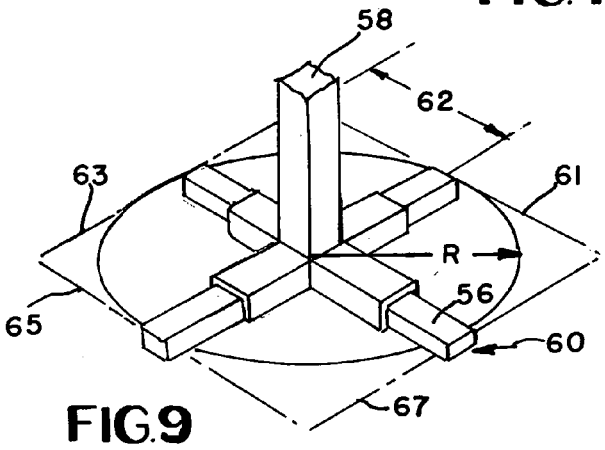
FIG. 9 is a top perspective view of the alternatively preferred base embodiment shown in FIG. 5 in an assembled configuration.

Specifically, the legs such as leg 56 extend away from a center portion 58 so that a distance between an outermost portion of the leg 56 and the center portion 58 is a first distance 62. The first distance has a greater length than second distance 64 measured intermediate the support 38 and a contact point of the cord 22 as it leaves the lifting arm 14 as shown in FIG. 1. Additionally, the second distance 64 is preferably shorter than the radius R as shown in FIG. 9. Radius R has a center at the center support 58 and is circumscribed within tangents 61,62,65,67 of the outermost points such as 60,66,68 of the legs and would also include the outermost point of fourth leg which is obscured from view in FIG. 1 but is seen in FIG. 8. As one skilled in the art would see, radius R is shorter than first distance 62 in most embodiments. This would assist in preventing a loaded lifting arm 14 from having the hoist 10 tip when a load is intermediate the legs.

Not only is the base support 58 to outermost point 60 of leg 56 first distance 62 greater than second distance 64 which is substantially a length of the lifting arm 14 in the preferred embodiment, it is preferably sufficiently longer so that tangents 61,63,65,67 defined intermediate outermost points of legs 64,66,68 and fourth leg (obscured from view in FIG. 1) are not intersected by the second distance 64 of the lifting arm 14. This is believed to add to the stability of the hoist 10 when in operation so that it does not inadvertently tip over during operation.

Figure 2:
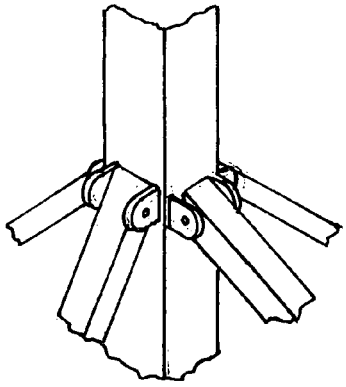
FIG. 2 is a detailed view of detail A shown in FIG. 1.
Figure 3:
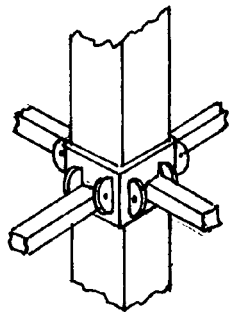
FIG. 3 is a detailed view of detail B shown in FIG. 1.

Legs 56,70,72,74 illustrated in FIG. 1 are hinged connected to a sleeve 76 as shown in detail in FIG. 3. Hinged connection is also welded to base support 58 so that the sleeve 76 can slide up and down relative the support 58. Furthermore, in the preferred embodiment a similar set of hinged constructions are connected directly to the legs 56,70,72,74 to allow the legs 56,70,72,74 to be folded relatively flat against the support 56 for transportation and storage. FIG. 2 shows a detailed hinged connection of the legs 56,70 relative to the support 58 as well. Hinged connected legs can be rapidly extended to a desired length 62 as explained above. The hoist 10 can be relatively rapidly set up by a technician to lift a compressor.

Figure 5:
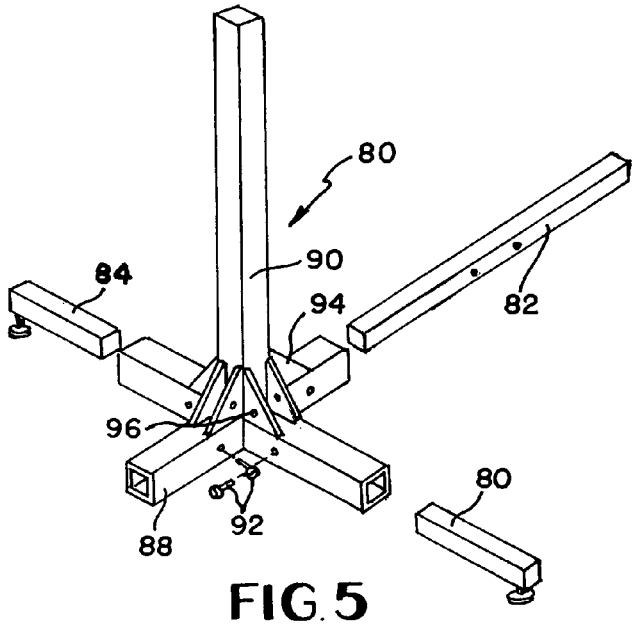
FIG. 5 is a first alternatively preferred embodiment of a base of the hoist shown in FIG. 1.

FIG. 5 shows an alternative configuration of a base 80 which utilizes legs 82,84,86. One skilled in the art will see that leg 82 is roughly slightly greater than twice the length of either of legs 84 and 86 so that it can be slid all the way through the sleeve 88 to effectively provide two legs opposite the support 90 with the other two legs 84,86 providing the remainder of the four leg structure.

Four legs has been found to provide a practical support for the base 12 but it is possible that other leg and base configurations could be used in other embodiments. Pins 92 were utilized to secure the legs 82,84,86 in position in the alternatively preferred embodiment of FIG. 5, and it is possible that locking structure could be utilized with the preferred embodiment of FIG. 1 as well. Gussets 94 of the alternatively preferred embodiment support 90 are useful to assist in strength to the alternatively preferred embodiment base 80. Pairs of gussets 94 are useful as shown to provide a location to store legs 82,84,86 when not in use with pins 92 in bores 96. Leveling feet 98 are also useful with one or more legs 82,84,86.

In operation, the base 12 is taken by a heating and air technician or other support personnel to a location and placed so that when the support 38 is installed, the lifting arm 14 will extends out over the compressor. The support 38 is then placed on the base 12 and the hook 28 lowered to grab the D-ring or other suitable grasping location of the compressor. The lifting mechanism 20 is then operated to lift the compressor above the surrounding structure of the remainder of the air conditioning and the support and the lifting arm 14 is rotated so that the compressor can be lowered out of the remainder of the air conditioning unit which can be accomplished with the lifting structure 20. A replacement compressor can then be connected to the hoist and the reversed application process ensues to locate the replacement compressor in the unit.

Through the use of the applicant's improved hoist 10 and method, the operator can replace the compressor in an HVAC unit without a need to bend over to pick up a relatively heavy compressor unit.

By constructing the hoist 10 primarily out of steel square tubing of an appropriate gauge, the hoist handler had no problem lifting over 180 pounds. The hoist 10 can be manufactured to lift a heaviest compressor for its intended service.

Figure 6:
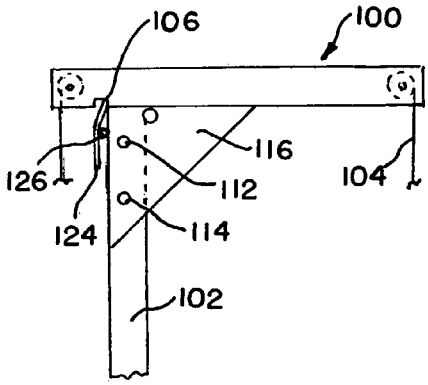
FIG. 6 is a side view of an alternatively preferred embodiment of a lifting arm in an in use configuration.
Figure 7:
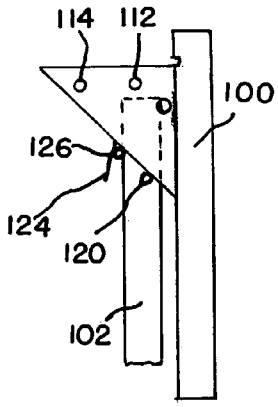
FIG. 7 is a side view of the alternatively preferred embodiment of the lifting arm shown in FIG. 6 in a storage configuration.

FIGS. 6-8 show an alternatively preferred embodiment of a lifting arm 100 with support 102. Cord 104 can be similarly connected as illustrated in other embodiments and could be a metal cable or other appropriate material preferably rated to handle at least the intended loading to be placed thereon. Lifting arm 100 is shown latched in position with latch 106 which cooperates with a cutout (obscured from view) in a portion of the lifting arm 100 to at least temporarily hold the position shown in FIGS. 6 and 8. Locking pins 108, 110 can then be inserted through bores 112, 114 in gussets 116, 118 and bores 120 (the other obscured from view) in support 102 to securely retain the lifting arm 100 at least substantially perpendicular (or otherwise) relative to support 102.

From the in use positions of FIGS. 6 and 8, the pins 108,110 may be removed and the latch 106 disengaged, such as by pushing lever 124 to rotate latch 106 about pivot 126 or otherwise. With latch 106 disengaged, the lifting arm 100 can be rotated about pivot 128 illustrated as hinge pin in a bore, such as a tube welded to the support 102. Hinge pin can pass through bores 130 in gussets 116 and 118.

By providing a folding construction of the lifting arm 100 relative to the support 102, a compact storage position for the preferred embodiments can be achieved.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An air conditioner compressor hoist comprising:

a base having an in use and a storage configuration; wherein when in said in use configuration, said base having at least three legs extending away from a base support to a first length defined as a radially greatest length from the base support along each of the three legs to a most distant point of each of the at least three legs from the base support for the at least three legs, and when in the storage configuration, at least portions of said at least three legs are one of removable and pivotable to a collapsed configuration having a second length defined from the base support to the most distant point of each of the at least three legs connected to the base support in the collapsed configuration, with the second distance being shorter than the first distance;

a cord connected to a drum operably coupled to the base;

a lifting arm and connected to an arm support rotatably positionable relative to the base, said lifting arm having a third length intermediate the support and a most distant contact point for the cord extending downwardly from the lifting arm in an in use configuration;

wherein the third length is greater than the second length;

at least one gusset at a connection of the lifting arm to the arm support, said gusset connecting the lifting arm to the arm support in the in use configuration;

a pivot connection connecting the lifting arm to the arm support, wherein said lifting arm may be rotated about the pivot connection to a storage configuration; and locking pins which pass through bores in the arm support and at least one gusset providing a hold configuration in use configuration and when the locking pins are removed, a release configuration is provided wherein the lifting arm is rotatable about the pivot connection to the storage configuration.

2. The air conditioner compressor hoist of claim 1 wherein the most distant points of the at least three legs from the base supports define tangents intermediate adjacent legs, and the third length does not intersect the tangents.

3. The air conditioner compressor hoist of claim 1 further comprising a latch having a hold configuration wherein the latch connects the lifting arm to the arm support in the in use configuration and a release configuration wherein the latch releases from at least one of the lifting arm and the arm support allowing the lifting arm to rotate about the pivot connection to the storage configuration.

4. The air conditioner compressor hoist of claim 1 wherein the at least one gusset further comprises opposing gussets symmetrically disposed relative to at least one of the arm support and the lifting arm.

5. The air conditioner compressor hoist of claim 4 further comprising a crank connected to the drum and said drum connected to the arm support with the cord extending from the drum up to the lifting arm, along at least a substantial portion of the third length and then downwardly.

6. The air conditioner compressor hoist of claim 5 wherein the drum is operably coupled to a ratcheting member.

7. The air conditioner compressor hoist of claim 6 wherein at least a portion of cord passes internal to the lifting arm.

8. The air conditioner compressor hoist of claim 7 wherein the contact point is a rolling member.

9. The air conditioner compressor hoist of claim 1 further comprising a base sleeve hingedly connected to the base support intermediate the at least three legs.

10. An air conditioner compressor hoist comprising:

a base having an in use and a storage configuration; wherein when in said in use configuration, said base having at least three legs extending away from a base support to a first length defined as a radially greatest length from the base support along each of the three legs to a most distant point of each of the at least three legs from the base support for the at least three legs, and when in the storage configuration, at least portions of said at least three legs are one of removable and pivotable to a collapsed configuration having a second length defined from the base support to the most distant point of each of the at least three legs connected to the base support in the collapsed configuration, with the second distance being shorter than the first distance;

a cord connected to a drum operably coupled to the base;

a lifting arm and connected to an arm support rotatable positionable relative to the base, said lifting arm having a third length intermediate the support and a most distant contact point for the cord extending downwardly from the lifting arm in an in use configuration; and wherein the third length is greater than the second length;

a first thrust plate at a top of the base support and a second thrust plate on a bottom of the arm support, said second thrust plate is rotatable relative to the first thrust plate, and the first thrust plate is connected to a lower conduit received in and connected to the base support and an upper conduit received in the arm support.

11. The air conditioner compressor hoist of claim 10 wherein the lower conduit is securely connected to the base support.

12. An air conditioner compressor hoist comprising:

a base having an in use and a storage configuration; wherein when in said in use configuration, said base having at least three legs extending away from a base support to a first length defined as a radially greatest length from the base support along each of the three legs to a most distant point of each of the at least three legs from the base support for the at least three legs, and when in the storage configuration, at least portions of said at least three legs are one of removable and pivotable to a collapsed configuration having a second length defined from the base support to the most distant point of each of the at least three legs connected to the base support in the collapsed configuration, with the second distance being shorter than the first distance;

a cord connected to a drum operably coupled to the base;

a lifting arm and connected to an arm support rotatably positionable relative to the base, said lifting arm having a third length intermediate the support and a most distant contact point for the cord extending downwardly from the lifting arm in an in use configuration; and wherein the third length is greater than the second length;

leg sleeves connected at bottom portion of the base support extending perpendicularly thereto; and wherein one of the three legs are a leg member received in at least one leg sleeve and extends completely through the at least one leg sleeve to provide two legs opposite the base support.

13. The air conditioner compressor hoist of claim 12 further comprising gussets connecting the leg sleeves to the base support.

* * * * *